US008371389B2

(12) United States Patent
Hofman et al.

(10) Patent No.: US 8,371,389 B2
(45) Date of Patent: Feb. 12, 2013

(54) DIFFERENTIAL SHIFTING TOOL AND METHOD OF SHIFTING

(75) Inventors: Raymond Hofman, Midland, TX (US); Steve Jackson, Richmond, TX (US)

(73) Assignee: Summit Downhole Dynamics, Ltd, Midland, TX (US)

( * ) Notice: Subject to any disclaimer, the term of this patent is extended or adjusted under 35 U.S.C. 154(b) by 276 days.

(21) Appl. No.: 12/844,160

(22) Filed: Jul. 27, 2010

(65) Prior Publication Data

US 2011/0226489 A1 Sep. 22, 2011

Related U.S. Application Data

(60) Provisional application No. 61/314,770, filed on Mar. 17, 2010.

(51) Int. Cl.
*E21B 23/00* (2006.01)
*E21B 23/04* (2006.01)

(52) U.S. Cl. ..... 166/382; 166/212; 166/217; 175/263; 175/279; 175/286; 175/289

(58) Field of Classification Search ..... 166/382, 166/212, 206, 217; 175/263, 279, 286, 289
See application file for complete search history.

(56) References Cited

U.S. PATENT DOCUMENTS

| | | | |
|---|---|---|---|
| 4,071,084 | A | 1/1978 | Brown et al. |
| 4,545,434 | A | 10/1985 | Higgins |
| 4,726,419 | A | 2/1988 | Zunkel |
| 5,609,178 | A | 3/1997 | Hennig et al. |
| 5,707,214 | A | 1/1998 | Schmidt |
| 5,988,285 | A | 11/1999 | Tucker et al. |
| 6,513,595 | B1 | 2/2003 | Freiheit et al. |
| 2004/0094310 | A1 | 5/2004 | Read, Jr. et al. |

*Primary Examiner* — Cathleen Hutchins

(57) ABSTRACT

A shifting tool and method of shifting a downhole device that requires only a minimal profile or no profile to engage and move the movable portion of the tool. The invention comprises a ported housing assembly and at least one friction pad alignable with said at least one port and radially movable through the port between a first pad position and a second pad position. In the second pad position, the friction pad extends outside said outer diameter of said housing assembly to engage the targeted downhole device. A mandrel positioned through the ported housing has a first section with a first outer diameter and a second section with a second outer diameter, said second outer diameter being greater than said first outer diameter. The mandrel is movable between a first mandrel position and a second mandrel position. In the second mandrel position, the second outer diameter supports the friction pads in the second pad position.

20 Claims, 9 Drawing Sheets

DIFFERENTIAL SHIFTING TOOL AND METHOD OF SHIFTING

CROSS-REFERENCES TO RELATED APPLICATIONS

This application claims the benefit of U.S. provisional application Ser. No. 61/314,770 filed Mar. 17, 2010 and entitled Differential Shifting Tool and Method of Shifting, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to oil and/or gas production. More specifically, the invention is a differential shifting tool and method for selectively actuating a downhole device.

2. Description of the Related Art

In hydrocarbon wells, fracturing (or "fracing") is a technique used by well operators to create or extend fractures from the wellbore deeper into the surrounding formation, thus increasing the surface area for formation fluids to flow into the well. Fracing is typically accomplished by either injecting fluids into the formation at high pressure (hydraulic fracturing) or injecting fluids laced with round granular material (proppant fracturing) into the formation. This requires selective actuation of downhole devices, such as fracing valves, to control fluid flow from the tubing string to the formation.

For example, U.S. Published Application No. 2008/0302538 (the '538 Publication), entitled Cemented Open Hole Selective Fracing System and which is incorporated by reference herein, describes one system for selectively actuating a fracing sleeve that incorporates a shifting tool. The tool is run into the tubing string and engages with a profile within the interior of the valve. An inner sleeve may then be moved to an open position to allow fracing or to a closed position to prevent fluid flow to or from the formation.

After the fracing process is complete and prior to the initiation of production operations, the ball and seat are typically milled out from each of the tools to allow a large flowpath through the producing string. After the milling process is complete, and as described in the '538 Publication, the shifting tool is disposed through the string and is caused to engage a profile within the downhole device, thus allowing the well operator to engage the moveable portion of the tool and close off the flow ports from the surrounding formation.

A common problem with conventional downhole devices during fracing and the milling process is the profile becomes damaged and/or destroyed. For example, it is not uncommon that the fracing process itself, which by its nature incorporates abrasive materials moving at high flow rates, erodes the engageable profile of the tool. To avoid this problem, well operators often limit the fracing flow rate to control erosion of the profile, which decreases the effectiveness of the fracing process and results in less than optimal results.

BRIEF SUMMARY OF THE INVENTION

The present invention provides a shifting tool and method of shifting a downhole device that requires only a minimal profile or no profile to engage and move the movable portion of the tool. The invention comprises a ported housing assembly and at least one friction pad alignable with said at least one port and radially movable through the port between a first pad position and a second pad position. In the second pad position, the friction pad extends outside said outer diameter of said housing assembly to engage the targeted downhole device. A mandrel positioned through the ported housing has a first section with a first outer diameter and a second section with a second outer diameter, said second outer diameter being greater than said first outer diameter. The mandrel is movable between a first mandrel position and a second mandrel position. In the second mandrel position, the second outer diameter supports the friction pads in the second pad position.

DETAILED DESCRIPTION OF THE INVENTION

When used with reference to the figures, unless otherwise specified, the terms "upwell," "above," "top," "upper," "downwell," "below," "bottom," "lower," and like terms are used relative to the direction of normal production through the tool and wellbore. Thus, normal production of hydrocarbons results in migration through the wellbore and production string from the downwell to upwell direction without regard to whether the tubing string is disposed in a vertical wellbore, a horizontal wellbore, or some combination of both. Similarly, during the fracing process, fracing fluids move from the surface in the downwell direction to the portion of the tubing string within the formation.

Figure 1:
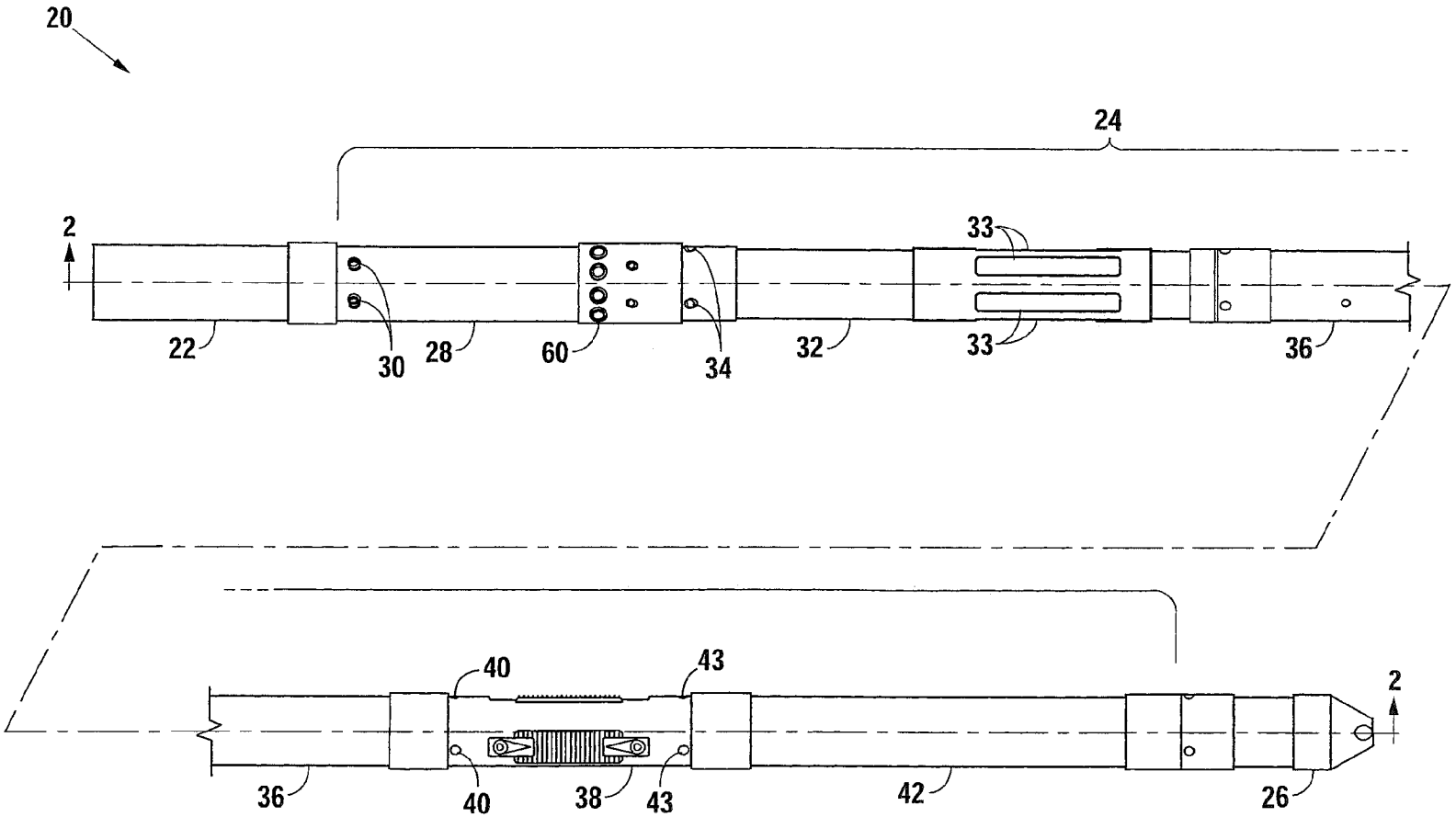
FIG. 1 is a side elevation view of the preferred embodiment.

FIG. 1 shows a side elevation of a preferred embodiment 20 of the present invention. A top connection 22 is connected to a housing assembly 24, which is connected to a bottom connection 26. The housing assembly 24 comprises a release housing 28 fastened to the top connection 22 with a series of radially-aligned screws 30. The upper end of a collet housing 32 having a series of collet ports 33 therethrough is threaded to and fixed to the bottom end of the release housing 28 with a series of radially-aligned screws 34. A spacer tube 36 is connected to the lower end of the collet housing 32. The top end of a pad housing 38 is threaded to and fixed to the bottom end of the spacer tube 36 with a series of radially-aligned screws 40. The top end of a spring housing 42 is threaded to and fixed to the bottom end of the pad housing 38 with a series of radially-aligned screws 43. The bottom connection 26 is threaded to and fixed to the bottom end of the spring housing 42.

Figure 2A:
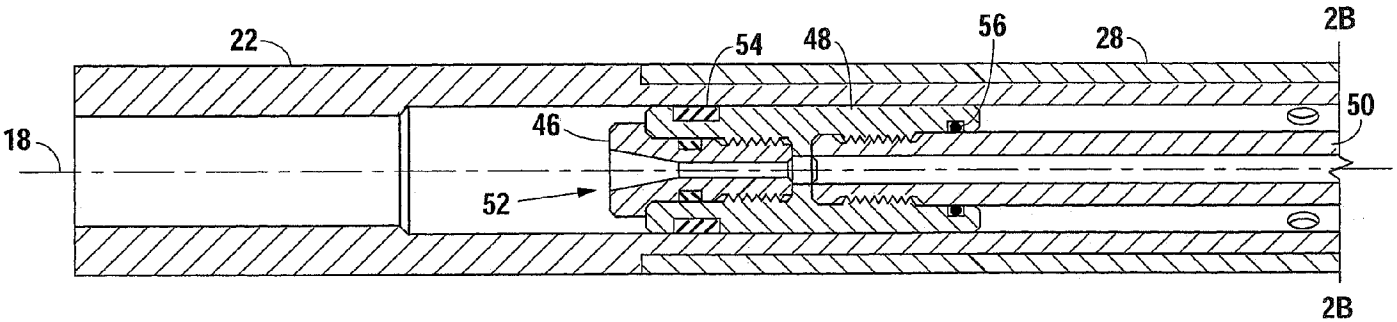
FIG. 2A through FIG. 2F are various sectional views of the preferred embodiment of the present invention.

FIG. 2A through FIG. 2F are sequential sectional elevations of the preferred embodiment 20 through section line 2-2 of FIG. 1 showing the shifting tool in a disengaged, or "run in," state. Referring to FIG. 2A, a jet insert 46 is located within the top connection 22 and release housing 28, and is threaded to the upper end of a jet receiver 48. The jet insert 46 includes a tapering portion 52 that restricts the size of the flowpath through which fluids can move. The lower end of the jet receiver 48 is threaded to the upper end of an upper mandrel 50. An annular backup ring 54 is circumferentially disposed around a groove formed in the outer surface of the jet receiver 48 to provide, along with a sealing element 56, pressure isolation from the annular pressure of the wellbore, thus allowing for a differential pressure condition between the interior and exterior of the upper mandrel 50.

Figure 2B:
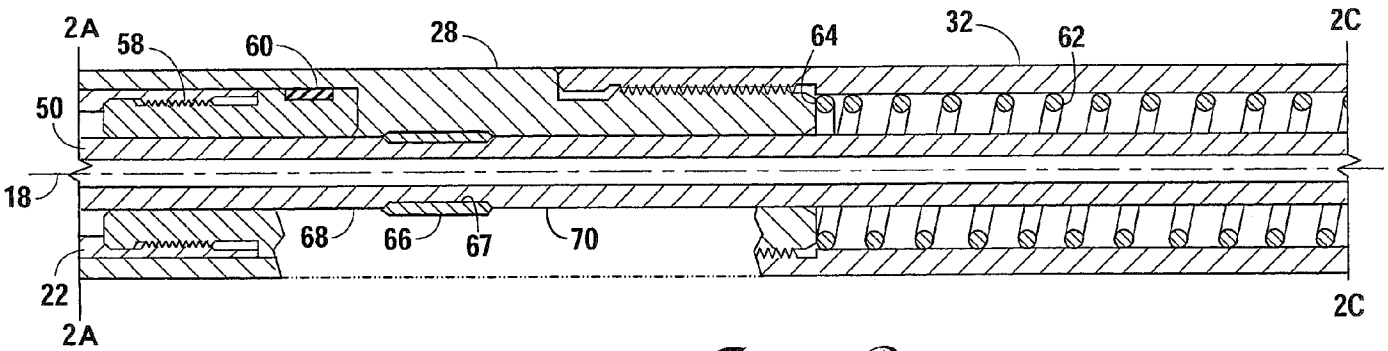

Referring to FIG. 2B, the release housing 28 is connected to a release nut 58 using screws 60. The top connection 22 is threaded to the upper end of the release nut 58. The upper mandrel 50 extends through, and is movable longitudinally within, the release nut 58 and into the collet housing 32. A collet spring 62 is positioned in the annular space between the upper mandrel 50 and the collet housing 32, and contacts the lower annular surface 64 of the release housing 28.

Referring again to FIG. 2B, a snap ring 66 is positioned around the upper mandrel 50 between first and second enlarged portions 68, 70, and within a snap ring groove 67 formed in the inner surface of the release housing 28. The snap ring 66 engages against the profile of the groove 67 to prevent longitudinal movement of the snap ring 66 and upper mandrel 50 until the pressure differential is sufficient to force the snap ring 66 out of the groove 67. This allows circulation to be established through the shifting tool up to a certain pressure differential without extending the collet 82 (see FIG. 2) so that the tool and the differential pressure can be freely moved up and down the tubing string. As flow rate is increased through the tool causing the differential pressure to increase past a first threshold, the snap ring 66 will be forced out of the groove 67 and allow the upper mandrel 50 to extend the friction pads 94 (see FIG. 2D) and engage the downhole device (e.g., the inner sleeve of a fracing valve). Thereafter, as long as the flow rate is maintained the valve can be opened or closed. When the flow rate is reduced, the differential pressure is reduced and the return spring 104 (see FIG. 2F) will cause the upper mandrel 50 and snap ring 66 to return to the run-in position, allowing the well operator to move to the next downhole tool or remove the shifting tool 20 from the tubing string. The upper end of the snap ring 66 is angled to minimize resistance when the snap ring 66 is moving upwell and returning to the run-in position shown in FIG. 2B.

Figure 2C:
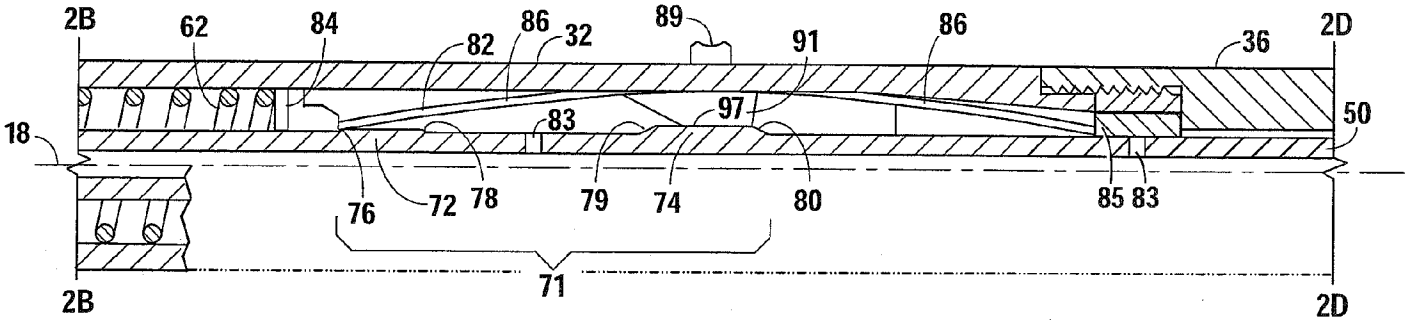

Referring to FIG. 2C, the upper mandrel 50 has a collet engaging section 71 that includes first and second enlarged sections 72, 74. The upper enlarged section 72 has an upper shoulder 76 angled at seventy-five degrees from the longitudinal axis 18 and a lower shoulder 78 angled at fifteen degrees from the longitudinal axis 18. The lower enlarged portion 74 has upper and lower annular shoulders 79, 80 that are inclined at fifteen degrees from the longitudinal axis 18.

A collet 82 is slidably positioned around the upper mandrel 50 proximal to the upper and lower enlarged sections 72, 74. The lower end of the collet spring 62 is in contact with an upper ring 84 of the collet 82. A lower ring 85 of the collet 32 is in contact with the spacer tube 36.

The upper mandrel 50 has ports 83 positioned between the upper and lower enlarged portions 72, 74 that provide access to the interior of the upper mandrel 50. The ports 83 allow the tool operator to establish circulation while running in the hole to wash out any debris that could prevent the shifting tool from getting downhole. The ports 83 allow this circulation and provide an exit path for fluid when the flow rate has created enough differential pressure to act against the spring 104 and extend the friction pads 94, as will be described with reference to FIG. 2D.

Figure 3A:
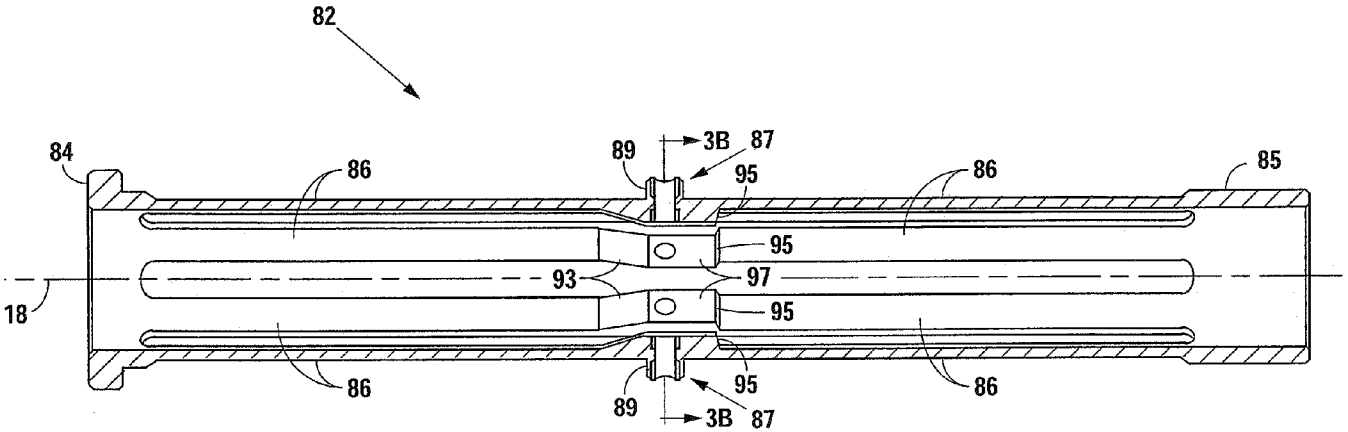
FIG. 3A and FIG. 3B are a side sectional and front sectional elevation of the collet described with reference to FIG. 2C.
Figure 3B:
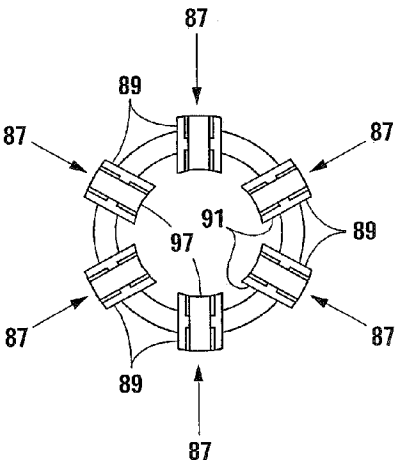

FIG. 3A and FIG. 3B show the collet 82 in greater detail. The collet 82 includes six equally radially spaced fingers 86 extending between the upper ring 84 and lower ring 85 that are radially flexible toward and away from the longitudinal axis 18 of the tool. A key 87 is formed in each finger 86 approximately equidistantly from the upper and lower rings 84, 85. Each key 87 includes a cylindrical outer portion 89 protruding radially outwardly of its corresponding finger 86 and an inner portion 91 having upper and lower shoulders 93, 95 that are angled at fifteen degrees and seventy-five degrees, respectively, from the longitudinal axis 18. A concave support surface 97 connects the upper and lower shoulders 93, 95 of each key 87.

Referring again to FIG. 2C, the collet fingers 86 are radially expanded as the support surfaces 97 contact the lower enlarged section 74, causing the outer portion 89 of the keys 87 to protrude through the collet ports 33 (see FIG. 1) in the collet housing 32.

Figure 2D:
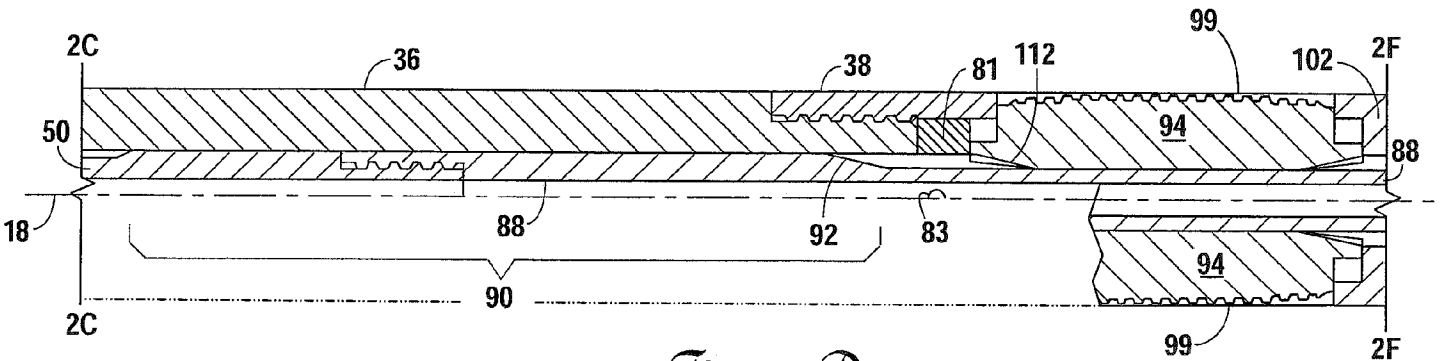

Referring to FIG. 2D, a spring ring 81 is fixed to the pad housing 38 adjacent the lower surface of the spacer tube 36. The upper mandrel 50 is threaded to a lower mandrel 88 to form a piston section 90 with an enlarged diameter. A lower annular shoulder 92 of the piston section 90 is angled at fifteen degrees from the longitudinal axis 18. Ports 83 are disposed through the lower mandrel 88 to allow the well operator to cause circulation between the lower mandrel 88 and the housing assembly 24, as described with reference to FIG. 2C. The friction pads 94 are spaced equally around the lower mandrel 88 downwell of the piston portion 90 and aligned with pad ports 99 disposed through the pad housing 38. The lower end of the pad housing 38 is connected to the upper end of the spring housing 42. The friction pads 94 has an upper inclined surface angled less than ten degrees relative to the lower shoulder 92.

Figure 2E:
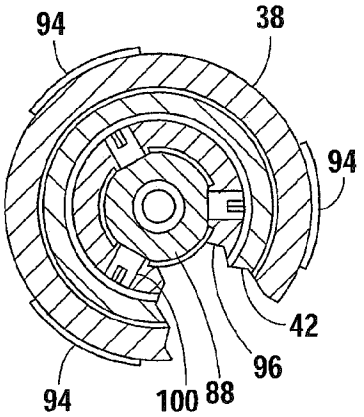
Figure 2F:
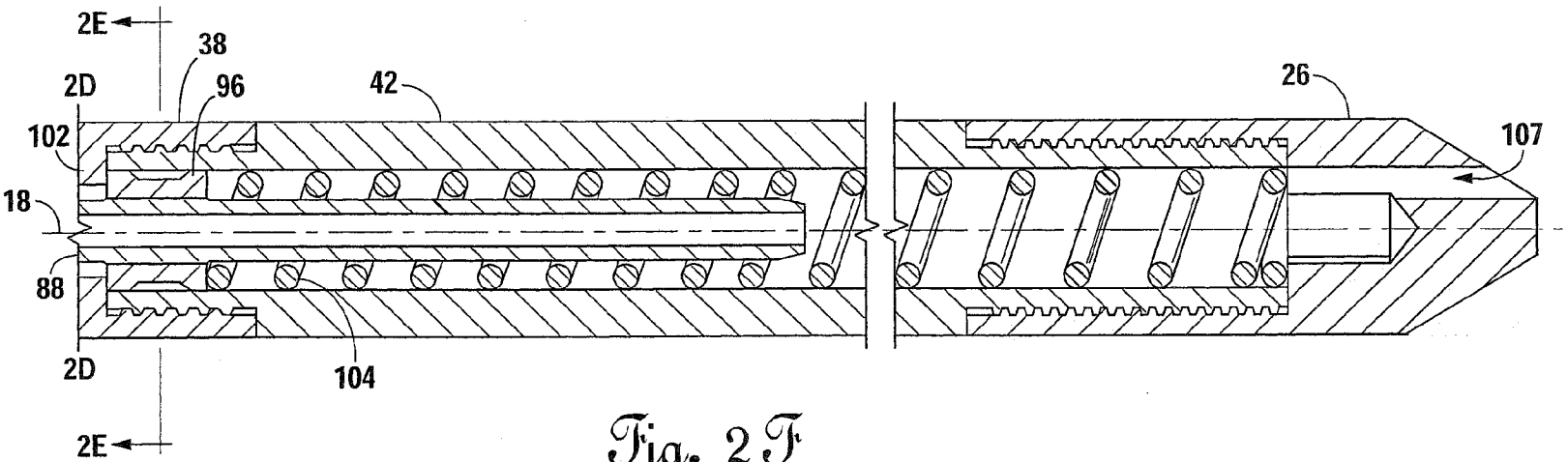

Referring to FIG. 2E and FIG. 2F, an annular spring stop 96 is fastened to the lower mandrel 88 at flattened areas 100 thereof with three equally radially-spaced screws 100. The lower mandrel 88 extends through a lower ring 102 integrally formed in the pad housing 38. A return spring 104 is positioned around the lower mandrel 88 and abuts the spring stop 96. The lower end of the spring housing 42 is threaded and fixed to the bottom connection 26, which has three flow ports 107 therethrough. The lower end of the return spring 104 is in contact with the bottom connection 26.

Figure 4A:
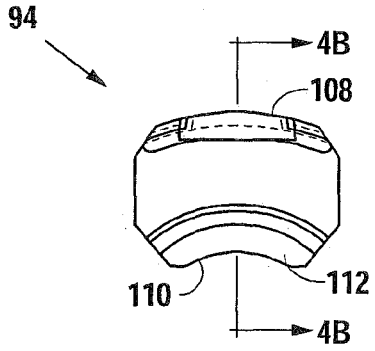
FIG. 4A through FIG. 4D are various views of a friction pad of the preferred embodiment of the invention.
Figure 4C:
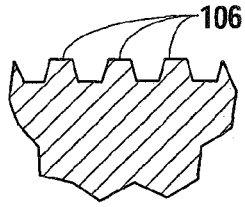
Figure 4B:
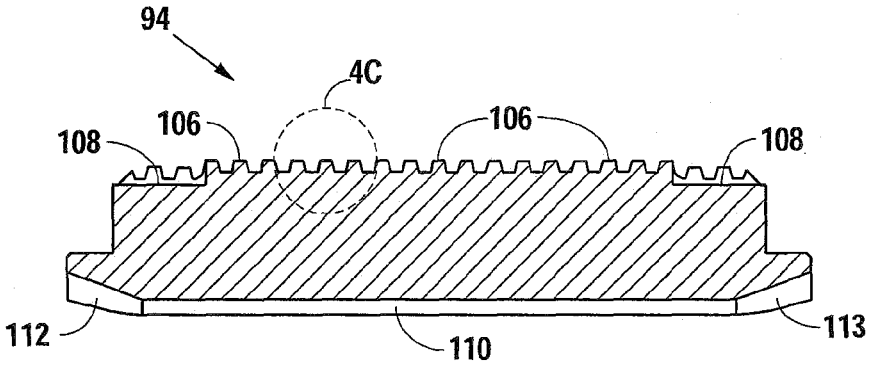

FIGS. 4A through 4C depict a friction pad 94 of the preferred embodiment in greater detail. The friction pad 94 includes a plurality of gripping members 106 formed in an outer surface 108. An inner surface 110 of the friction pad 94 corresponds in curvature to the piston portion 90 of the lower mandrel 88 (see FIGS. 2C & 2D). The inner surface 110 includes upper and lower inclined surfaces 112, 113 angled at twenty degrees from the longitudinal axis 18.

Figure 4D:
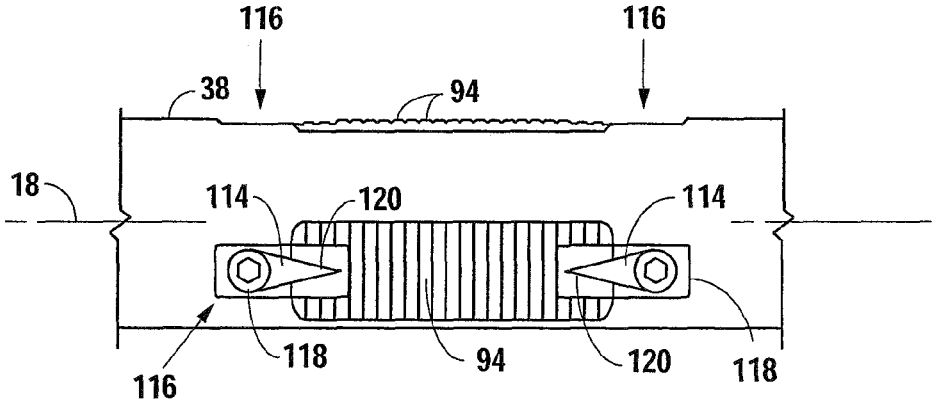

FIG. 4D is a side elevation of a portion of the preferred embodiment that more fully shows retention of the friction pads 94 within the pad housing 38. In the "run-in" state, the friction pads 94 are held within pad housing 38 with slip springs 114 fastened to recessed portions 116 of the pad housing 38 with screws 118. The slip springs 114 have a tapering end 120 that allows the slip springs 114 to bend outwardly as the corresponding friction pad 94 moves radially outwardly.

Figure 5A:
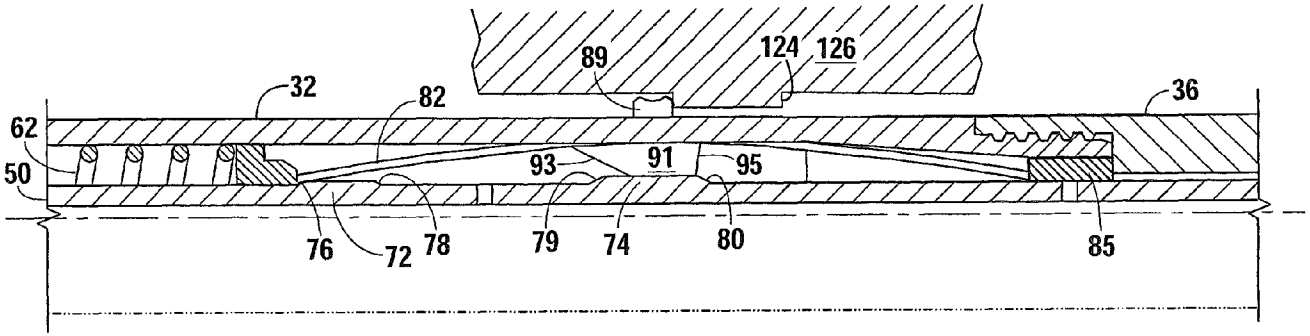
FIG. 5A through FIG. 5C describe operation of the preferred embodiment as it engages a profile of a downhole device.

FIG. 5A shows engagement of the shifting tool with a profile 124 left by the drilling out of a ball seat in an inner sleeve 126 (or another element of a downhole device). As the inner diameter of the inner sleeve 126 narrows, the outer portions 89 of the keys 87 will engage the inner sleeve 126.

Figure 5B:
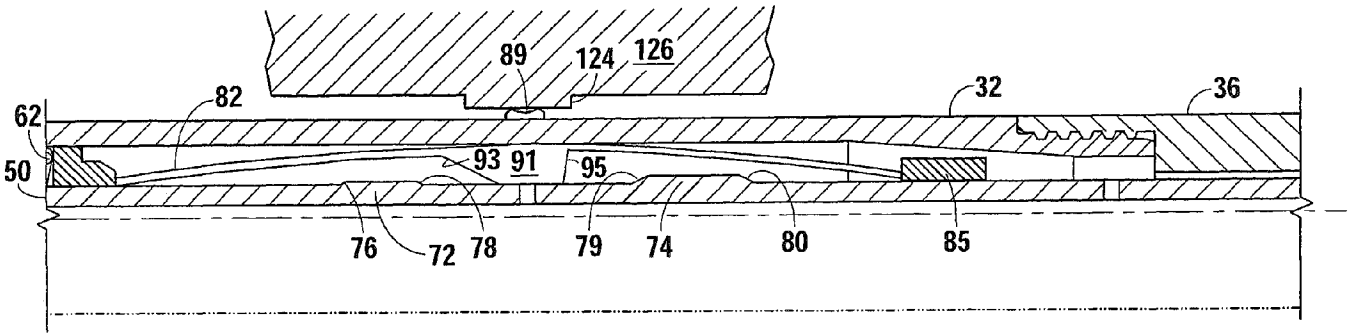

As shown in FIG. 5B, as the shifting tool is run further downwell, the collet 82 resists downwell movement and remains stationary relative to the inner sleeve 126, which causes compression of the collet spring 62 to urge the collet 82 downwell. The inner portions 91 of the collet 82 move upwell of the second enlarged portion 74, which allows the upper portion 89 to recede into the collet housing 32.

Figure 5C:
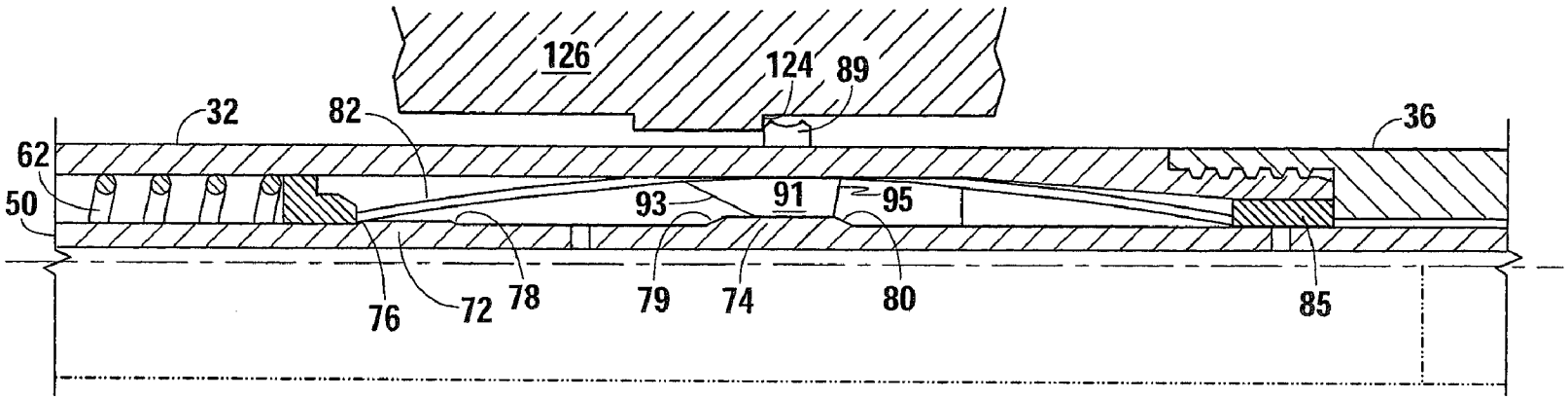

Thereafter, as shown in FIG. 5C, the collet spring 62 urges the collet 82 downwell and back into the first position where keys 87 protrude past the outer diameter of the collet housing 32 and the lower ring 85 of the collet 82 is in contact with the spacer tube 36. The collet 82 resists any upwell movement as the lower ring 85 of the collet 82 cannot move further downwell. In this manner, the collet 82 will "snap through" the profile 124 left after milling out, but will "land" downwell of the profile 124 as the tool is thereafter pulled upwell by the well operator.

Figure 6A:
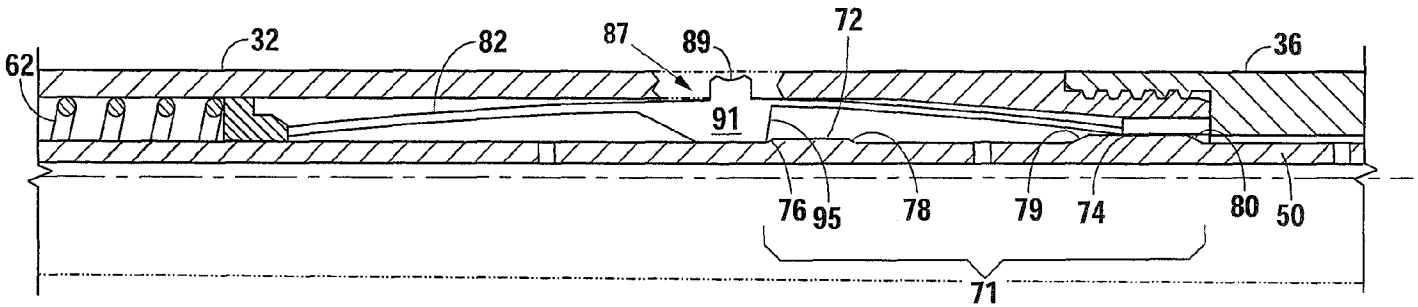
FIG. 6A and FIG. 6B show the collet friction pads, respectively, of the preferred embodiment when the shifting tool has engaged a downhole device.
Figure 6B:
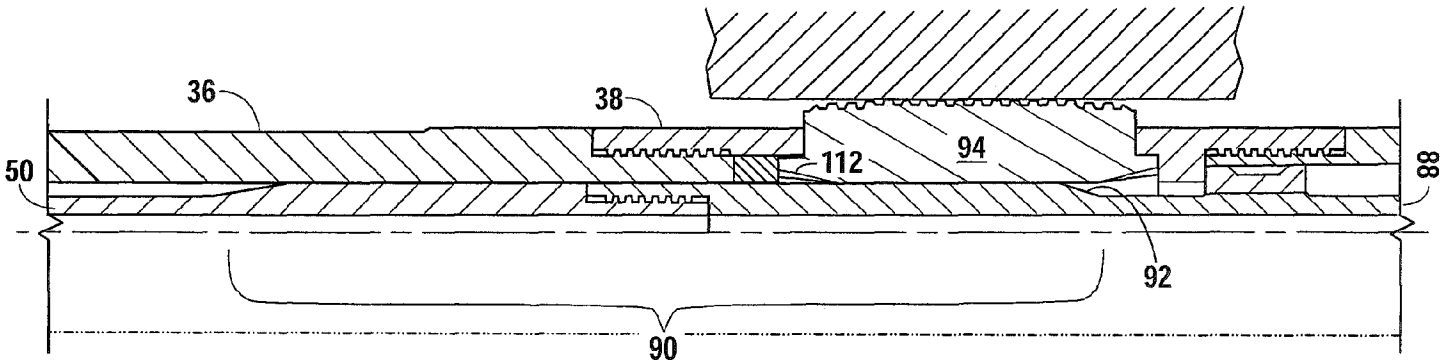

FIGS. 6A and 6B depict the shifting tool in the engaged state after a differential pressure condition has caused the upper and lower mandrels 50, 88 to move downwell to the second position. As shown in FIG. 6A, at a first differential pressure, the upper mandrel 50 is in a second position downwell from the first position shown in FIG. 2A through FIG. 2F. In the second position, the first and second enlarged sections 72, 74 of the upper mandrel 50 are downwell of the keys 87. The upper shoulder 76 of the first enlarged section 72 is engaged with the lower shoulder 95 of the inner portions 91. Outer portions 89 of the key 87 are within the outer diameter of the collet housing 32.

As shown in FIG. 6B, the piston section 90 has moved downwell to the second position within the pad housing 38. In the second position, the friction pads 94 are supported by at least part of the piston section 90 of the lower mandrel 88. When moving to this position, the upper inclined surface 112 of each friction pad 94 is engaged by the lower annular shoulder 92 of the piston section 90 to facilitate radial outward movement of the friction pads 94. In this position, the slip springs 114 urge the frictions pads 94 radially inwardly such that, when the piston portion 90 no longer supports the friction pads 94 (i.e., when the differential pressure condition is overcome by the expansive force of the return spring 104), the friction pads 94 are moved radially inwardly by the slip springs 114.

Thereafter, the sleeve of the downhole device can be shifted open/closed by application of tension or compression through the work string as long as flow is maintained in the shifting tool to support the friction pads 94 in the expanded position. Upon completion of the shifting of the inner sleeve into the open/closed position, fluid flow to the shifting tool is reduced, resulting in a decrease of differential pressure until the return spring 104 urges the spring stop 96 and connected lower mandrel 88 back to the first position shown in FIG. 2D. As the friction pads 94 would no longer be supported by piston section 90, the shifting tool is disengaged from the downhole device.

Because of engagement of the inner portion 91 of the keys 87 with the upper enlarged portion 72 of the upper mandrel 50, the upper portions 89 of the keys 87 remain within the outer diameter of the collet housing 32, and thus cannot engage the inner surface of the downhole device. This ensures that the shifting tool can be removed from the downhole device with engaging any profile 124 (see FIG. 5A-5C). After removal of the shifting tool, the well operator may reset the tool to the run-in state by inserting screws into the threaded holes (see FIGS. 3A & 3B) and expanding the collet 82 to allow repositioning relative to the upper mandrel 50, as described with reference to FIGS. 2A through 2F.

The present invention is described above in terms of a preferred illustrative embodiment of a specifically-described shifting tool and method. Those skilled in the art will recognize that alternative constructions of such an apparatus can be used in carrying out the present invention. Other aspects, features, and advantages of the present invention may be obtained from a study of this disclosure and the drawings, along with the appended claims.

We claim:

1. A shifting tool for use in a hydrocarbon production well, the shifting tool comprising:

a housing assembly having an annular sidewall, at least one pad port disposed through said sidewall, and at least one collet port disposed through said sidewall;

at least one friction pad alignable with said at least one pad port, said at least one friction pad being radially movable through said at least one pad port between a first pad position and a second pad position, wherein in said second pad position said at least one friction pad extends through said at least one pad port;

a mandrel having a flowpath extending between an upper end and a lower end, said mandrel being positioned at least partially within said housing assembly and having a piston section and a collet engaging section, wherein said mandrel is moveable between a first mandrel position and a second mandrel position, wherein in said second mandrel position said piston section supports said at least one friction pad in said second pad position;

a collet having an upper end, a lower end, a plurality of keys moveable between a first key position and a second key position, each of said keys having an inner portion and an outer portion, wherein in said second key position said outer portion extends through said at least one collet port;

a collet spring positioned in the annular space between said mandrel and said housing assembly, said collet spring being longitudinally compressible by upwell movement of said collet;

a spring stop fastened to said mandrel;

a return spring having an upper and lower end, wherein said return spring is compressible by downwell movement of said spring stop;

wherein said collet engagement section comprises an first enlarged portion positioned upwell of a second enlarged portion.

2. The shifting tool of claim 1 further comprising a jet insert coupled to said upper end of said mandrel.

3. The shifting tool of claim 1 wherein said collet comprises:

an upper ring positioned around said mandrel and adjacent to a lower end of said collet spring;

a lower ring positioned around said mandrel;

a plurality of fingers extending between said upper ring and said lower ring, said fingers being radially flexible toward and away from said mandrel; and wherein said at least one key is formed in said plurality of fingers and said inner portion of said at least one key contacting said mandrel.

4. The shifting tool of claim 1 further comprising a ported bottom connection connected to said housing assembly, the lower end of said return spring being compressible against said bottom connection.

5. The shifting tool of claim 1 wherein said friction pad comprises an outer surface, a plurality of gripping members formed in said outer surface, and an inner surface that corresponds in curvature to the piston section of the mandrel.

6. The shifting tool of claim 1 wherein an upper shoulder of said collet engagement section is engageable with the inner portion of said at least one key of said collet to prevent downwell movement of said inner portion into said collet engaging section.

7. The shifting tool of claim 1 wherein said housing assembly comprises:

a collet housing;

a release housing connected to said collet housing;

a spacer tube connected to said collet housing;

a pad housing connected to said spacer tube; and a spring housing connected to said pad housing; and wherein said collet spring is positioned longitudinally between said upper end of said collet and said release housing.

8. The shifting tool of claim 7 further comprising a top connection connected to said release housing.

9. The shifting tool of claim 8 further comprising a release nut positioned around said mandrel and threaded to the lower end of said top connection.

10. The shifting tool of claim 7 further comprising a lower ring integrally formed in the pad housing, wherein upwell movement of said spring stop is limited by said lower ring.

11. The shifting tool of claim 1 wherein said mandrel comprises an upper mandrel and a lower mandrel.

12. The shifting tool of claim 1 wherein said inner portion of said at least one key comprises an upper shoulder and a lower shoulder, said lower shoulder being engageable with an upper shoulder of said collet engagement section to prevent downwell movement of said inner portion past said first engagement section.

13. The shifting tool of claim 1 wherein:

said piston section comprises a lower shoulder inclined at a first angle relative to said longitudinal axis; and said at least one friction pad comprises an upper inclined surface angled less than ten degrees relative to said lower shoulder.

14. The shifting tool of claim 1 further comprising at least one spring urging said at least friction pad radially inward when said at least one friction pad is in said second pad position.

15. A method of shifting an inner sleeve of a downhole device disposed in a tubing string, the method comprising:

introducing a tool into said tubing string proximal to the device, said tool comprising:

a housing assembly having at least one pad port and at least one collet port;

a mandrel having a piston section and a collet engaging section, said mandrel being longitudinally moveable within said housing assembly;

a collet having an upper end, a lower end, a plurality of keys radially moveable between a first key position and a second key position, each of said keys having an inner portion and an outer portion, wherein in said second key position said outer portion extends through said at least one collet port;

at least one friction pad alignable with said at least one pad port, said at least one friction pad being radially movable through said at least one pad port between a first pad position and a second pad position, wherein in said second pad position said at least one friction pad extends through said at least one port;

extending said outer portion of said at least one key past a first predetermined position in said downhole device, said first predetermined position having a first inner diameter less than the outer diameter of said at least one key;

limiting upwell movement of said tool past said first predetermined position;

moving said piston section of said mandrel to a second position that is radially within said at least one friction pad to cause said at least one friction pad to engage the inner sleeve; and moving said collet engagement section downwell of said at least one key.

16. The method of claim 15 further comprising a step of moving the tool while said at least one friction pad is engaged with the downhole tool.

17. The method of claim 15 wherein said step of moving said piston section further comprises a step of pumping a fluid through said mandrel at a flow rate to create a differential pressure between said flowpath and the exterior of said mandrel.

18. The method of claim 15 wherein said extending step comprises:

moving said mandrel downwell relative to said at least one key; and contracting said at least one key around said mandrel to allow further downwell movement of said at least one key relative to the tubing string.

19. The method of claim 15 wherein said limiting step comprises:

expanding said at least one key to a diameter larger than the diameter of said first inner diameter; and limiting further downwell movement of said at least one key relative to said housing assembly.

20. The method of claim 17 wherein said tool further comprises a spring stop fastened to said mandrel and a return spring, wherein said return spring is compressible by movement of said spring stop, said method further comprising a step of reducing the flow rate to cause a differential pressure lower than the expansive force of said return spring.

* * * * *